US006485359B1

(12) United States Patent
Li et al.

(10) Patent No.: US 6,485,359 B1
(45) Date of Patent: Nov. 26, 2002

(54) PLATEN ARRANGEMENT FOR A CHEMICAL-MECHANICAL PLANARIZATION APPARATUS

(75) Inventors: Shijian Li, San Jose; Fred C. Redeker, Fremont; John White, Hayward; Manoocher Birang, Mountain View, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/663,815

(22) Filed: Sep. 15, 2000

(51) Int. Cl.[7] ..... B24B 29/00

(52) U.S. Cl. ..... 451/289; 451/41; 451/53; 451/287; 451/288; 451/388

(58) Field of Search ..... 451/41, 53, 287, 451/288, 289, 388

(56) References Cited

U.S. PATENT DOCUMENTS 6,033,293 A * 3/2000 Crevasse et al. ..... 451/494
6,149,506 A * 11/2000 Duescher ..... 451/59
6,244,935 B1 6/2001 Birang ..... 451/41

FOREIGN PATENT DOCUMENTS

EP 0 653 270 A1 5/1995
JP 60-228070 11/1985

* cited by examiner

*Primary Examiner*—Joseph J. Hail, III
*Assistant Examiner*—Shantese McDonald
(74) *Attorney, Agent, or Firm*—Moser, Patterson and Sheridan

(57) ABSTRACT

A chemical mechanical polishing machine is provided with a platen that has an integral sub-pad. A fixed abrasive polishing layer is mounted, without adhesive between the polishing layer and the sub-pad, to the top surface of the platen and the sub-pad. The polishing layer is vacuum mounted, for example, to the integral sub-pad of the platen. A cooling arrangement is provided in the platen that cools the polishing layer and improves product quality.

20 Claims, 2 Drawing Sheets

PLATEN ARRANGEMENT FOR A CHEMICAL-MECHANICAL PLANARIZATION APPARATUS

FIELD OF THE INVENTION

The present invention relates to polishing and planarizing of surfaces, such as semiconductor wafer surfaces, and more particularly, to fixed abrasive pad and platen arrangements for chemical-mechanical polishing/planarizing of semiconductor wafers.

BACKGROUND OF THE INVENTION

In the process of fabricating modem semiconductor integrated circuits (ICs), it is necessary to form various material layers and structures over previously formed layers and structures. However, the prior formations often leave the top surface topography of an in-process wafer highly irregular, with bumps, areas of unequal elevation, troughs, trenches, and/or other surface irregularities. These irregularities cause problems when forming the next layer. For example, when printing a photographic pattern having small geometries over previously formed layers, a very shallow depth of focus is required. Accordingly, it becomes essential to have a flat and planar surface, otherwise, some parts of the pattern will be in focus and other parts will not. In fact, surface variations on the order of less than 1000 angstroms over a 25×25 mm die would be preferable. In addition, if the irregularities are not leveled at each major processing step, the surface topography of the wafer can become even more irregular, causing further problems as the layers stack up during further processing. Depending on the die type and the size of the geometries involved, it is desirable to effect some type of planarization, or leveling, of the IC structures. In fact, most high-density IC fabrication techniques make use of some method to form a planarized wafer surface at critical points in the manufacturing process.

One method for achieving semiconductor wafer planarization or topography removal is the chemical-mechanical planarization/polishing (CMP) process. In general, the CMP process involves holding the wafer against and moving the wafer relative to a polishing platen under a controlled pressure or friction force. A typical CMP apparatus includes a polishing head for holding the semiconductor wafer against the polishing platen. The polishing platen is covered with a pad. The pad is usually either an open cell foamed polyurethane (e.g. Rodel IC1000) or a sheet of polyurethane with a grooved surface (e.g. Rodel EX2000). The pad surface is wetted with a polishing slurry containing chemicals and, optionally, abrasive particles. This pad typically has a backing layer called a sub-pad that interfaces with the surface of the platen.

Another type of polishing pad is the "fixed-abrasive pad" made from abrasive particles fixedly dispersed in a suspension medium. Unlike conventional CMP slurries, the planarizing liquid employed with a fixed abrasive pad may be free of abrasive particles, i.e., a polishing chemical solution. Chemical-mechanical polishing/planarization with a chemical solution on a fixed abrasive pad offers several desirable aspects: low chemical cost, low dishing, and a good top surface finishing.

One concern with metal CMP is the heat generated during the polishing process, caused by chemical reaction of the metal with the polishing chemical and the friction of the wafer against the fixed abrasive pad surface. Heat build-up may degrade the quality of the wafer being polished. Fixed abrasive pads with thick stacks exhibit poor thermal conductivity and, therefore, wafers are not readily cooled during CMP on such pads.

Another concern is the dishing observed generally in metal CMP. Dishing can be high if the pad modulus is low. A conventional fixed abrasive pad may include polishing elements of 40 $\mu$m in height that are mounted in a thin Mylar™ sheet. The other layers below the Mylar™ sheet form a sub-pad stack, and may have five layers, for example. A top adhesive layer joins the Mylar™ sheet to the sub-stack. A polycarbonate layer, which is supposed to provide the necessary pad modulus, is underneath the top adhesive layer, and a foam layer, which is supposed to provide long range flexibility, is joined to the polycarbonate layer by a middle adhesive layer. A bottom adhesive layer on the foam layer attaches the polishing pad formed by the Mylar™ sheet and sub-pad stack to the top of the platen. However, due to the existence of the layer of very soft adhesive material between the very thin Mylar™ sheet and the polycarbonate layer, the modulus of the integrated pad of six layers cannot be high enough for strict dishing requirements. Elimination of this adhesive layer would greatly increase the pad modulus and help the pad dishing performance.

A further concern is the consumable cost of fixed abrasive polishing pads. Although only the top Mylar™ layer is subjected to wear during polishing, the entire pad is normally replaced when the Mylar™ pad is excessively worn. This increases the cost of ownership.

Another concern is the system vibration that may occur when polishing with conventional fixed abrasive pads. Such vibrations can occur due to the typical construction of fixed abrasive pads, and their attachment on top of a platen. The foam pad that forms part of the polishing pad is not readily changeable to damp the system vibrations of an individual polisher.

SUMMARY OF THE INVENTION

The present invention overcomes problems with existing fixed abrasive polishing pads by providing a platen for a fixed abrasive pad arrangement, comprising a platen housing, a sub-structure integrally mounted on the platen housing, and a mounting arrangement configured to removably mount a fixed abrasive layer to the integral sub-structure.

One of the aspects of certain embodiments of the fixed abrasive pad arrangement of the present invention is that the fixed abrasive layer may be readily replaced since it is removably mounted to the sub-structure, or sub-pad. As the platen has an integral sub-pad, the sub-pad does not have to be replaced whenever the top polishing layer requires replacing. This reduces consumable expenses, as only the top polishing layer is replaced, rather than an entire polishing pad with sub-layers together.

As the sub-structure is integrally mounted on the platen housing, a cooling arrangement may be provided that improves the cooling of the overall sub-structure and fixed abrasive layer, in comparison to conventional fixed abrasive polishing pads that include a sub-structure stack and a fixed abrasive layer. Since the sub-structure is integral to the platen housing in certain embodiments of the invention, a cooling arrangement in accordance with embodiments of the invention may be provided that better cools the sub-structure and the fixed abrasive layer.

An aspect of the present invention provides a chemical-mechanical polishing machine comprising a platen housing, a sub-pad integral with the platen housing, and a mounting arrangement configured to removably mount a fixed abrasive layer to the sub-structure. In certain embodiments of the invention, the mounting arrangement includes a vacuum mounting arrangement that removably and quickly mounts the fixed abrasive layer to the sub-structure, without the use of adhesive. Eliminating the adhesive between the fixed abrasive layer and the sub-structure reduces the undesirable phenomenon of dishing.

The foregoing and other features, aspects and advantages of the present invention will become more apparent from the following detailed description of the present invention when taken in conjunction with the accompanying drawings.

DETAILED DESCRIPTION OF THE INVENTION

The present invention addresses and solves problems related to fixed abrasive polishing pads, including difficulties in pad cooling, vibration damping, and dishing and further reduces the cost of the pad. The present invention achieves this, in part, by providing a fixed abrasive pad arrangement in which the sub-pad is integral to the platen. The fixed abrasive polishing layer is removably mountable on the sub-pad. The integral nature of the sub-pad allows pad cooling to be established since the sub-pad is not replaced when the fixed abrasive polishing layer is replaced. Improved vibration damping may be achieved since the foam pad layer of the sub-pad may be selected specifically to damp system vibrations. Dishing is reduced when the fixed abrasive polishing layer is mounted by a vacuum mount, or by adhesive at the edges. This avoids the use of an adhesive layer between the fixed abrasive polishing layer and the sub-pad, which is advantageous as such an adhesive layer can contribute to dishing.

Figure 1:
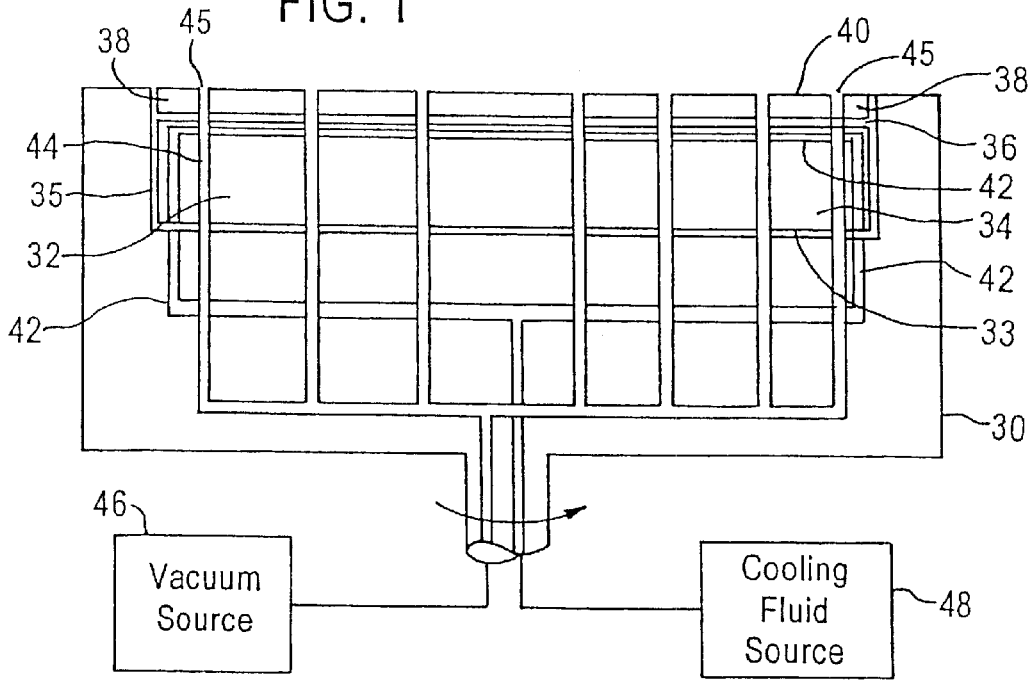
FIG. 1 is a cross-section of a fixed abrasive pad arrangement constructed in accordance with an embodiment of the present invention.

FIG. 1 is a cross-section of a fixed abrasive pad arrangement in accordance with an embodiment of the present invention. The arrangement includes a platen 30 on which a sub-pad 32 is integrally provided. The sub-pad 32 is fixedly mounted, by adhesive 33, for example, within a recess 35 in the platen 30. The sub-pad 32 may be integrated into the platen 30 by other mechanisms, such as mechanical fasteners, etc.

The sub-pad 32 comprises a foam layer 34 that is attached to the bottom of the recess 35. An adhesive layer 36 connects a structural layer 38 to the top of the foam layer 34. The foam layer 34 provides long-range polishing uniformity adjustment, while the structural layer 38 provides hardness to increase characteristic length and reduce dishing. In certain embodiments, the structural layer 38 can be a polycarbonate layer.

The platen 30, with the integral sub-pad 32, is configured to receive a fixed abrasive polishing layer (not shown in FIG. 1) on the top surface 40 of the structural layer 38. However, since the sub-pad 32 is integral to the platen 30, the fixed abrasive polishing layer is the only layer that needs frequent replacement due to wear. Since frequent replacement of the fixed abrasive polishing layer is contemplated, it is advantageous to avoid the use of adhesive to mount the fixed abrasive polishing layer to the top surface 40 of the structural layer 38. Embodiments of the present invention, such as that depicted in FIG. 1, include a mounting arrangement that removably mounts the fixed abrasive polishing layer.

In certain embodiments of the present invention, the mounting arrangement is a vacuum mounting arrangement that includes a vacuum source 46 that communicates through the platen 30 to vacuum conduits 44. The vacuum conduits 44 open at vacuum openings 45 at the top surface 40 of the structural layer 38, to thereby form a vacuum-mounting surface. The very edge of the fixed abrasive polishing layer 50 can be adhered to the edge of the platen 30, to make sure the polishing layer 50 will not peel off during CMP operation.

Figure 2:
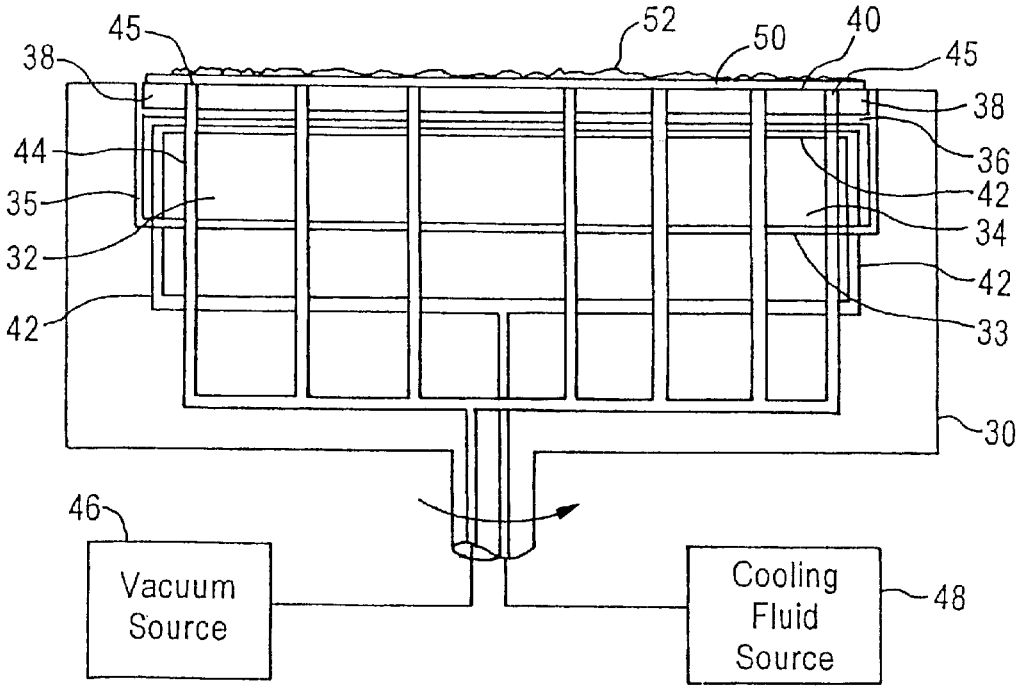
FIG. 2 depicts the arrangement of FIG. 1, with a fixed abrasive layer mounted to the platen and sub-pad of FIG. 1.

FIG. 2 depicts the platen 30 of FIG. 1, with a fixed abrasive polishing layer 50 vacuum-mounted thereon. The fixed abrasive polishing layer 50, in certain embodiments, comprises a Mylar™ sheet on which abrasive elements 52 are fixedly dispersed in a suspension medium. The fixed abrasive polishing layer 50 is easily mounted by applying vacuum, which creates negative pressure at the vacuum opening 45, thereby covering the top surface 40 with the fixed abrasive polishing layer 50.

Removal of the polishing layer 50 is accomplished by cutting off the vacuum and lifting off the polishing layer 50. Providing slight positive pressure through the vacuum conduits 44 is employed in certain embodiments to aid in removal of the polishing layer 50. The avoidance of adhesive directly between the fixed abrasive polishing layer 50 and the structural layer 38 reduces dishing, in addition to making the replacement of the fixed abrasive polishing layer 50 much easier.

Referring back to FIG. 1, the platen 30 also includes a cooling arrangement that serves to cool the fixed abrasive polishing layer 50 when it is mounted and the polishing process occurs. Since the sub-pad 32 is integral to the platen 30, and is not meant to be frequently replaced, a cooling arrangement that includes cooling fluid conduits 42 through the sub-pad 32 can be employed. The cooling fluid conduits 42 are coupled to a cooling fluid source 48. The cooling fluid conduits 42 form a closed-loop system and extend through the foam layer 34 to bear against the structural layer 38. Since the foam layer 34 is not normally highly thermally conductive, directly cooling the structural layer 38 through the conduits 42 provides a more efficient and increased cooling of the structural layer 38, and therefore, a mounted fixed abrasive polishing layer 50. If the platen is rotatable, rotary couplings (not shown) are used to couple the vacuum conduits 44 to the vacuum source 46 and the cooling fluid conduits 42 to the cooling fluid source 48.

Figure 3:
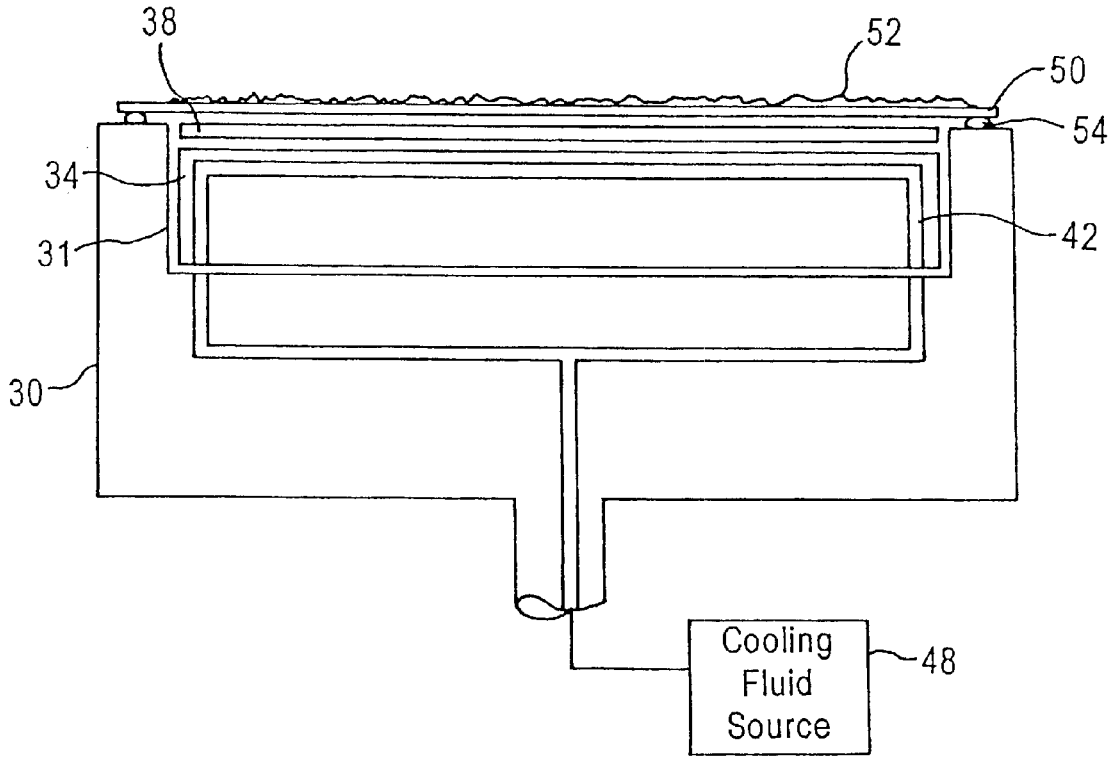
FIG. 3 depicts a cross-section of a fixed abrasive pad arrangement in accordance with another embodiment of the present invention, with a fixed abrasive layer mounted to the platen and sub-pad.

FIG. 3 illustrates another embodiment of the present invention, which employs an alternative mounting arrangement. In the embodiment of FIG. 3, a seal is provided on the platen edge 54. The seal may be an o-ring seal 60, as shown in FIG. 3. Alternatively, adhesive may be provided on the platen edge 54, and the edges of the fixed abrasive polishing layer 50 pressed down on the adhesive at the platen edge 50 to hold the fixed abrasive polishing layer 50 on the sub-pad 32. There is no adhesive between the polishing layer 50 and the structural layer 38, so that increased dishing does not become a problem.

The present invention, described above, increases cooling of the polishing layer, allows for improvements in damping of system vibration, reduces dishing, and lowers the costs of operation, as only a single polishing layer needs to be replaced frequently and not the sub-pad, which is integral to the platen.

Although the present invention has been described and illustrated in detail, it is to be clearly understood that the same is by way of illustration and example only and is not to be taken by way of limitation, the scope of the present invention being limited only by the terms of the appended claims.

What is claimed is:

1. A platen for a fixed abrasive pad chemical-mechanical polishing/planarization arrangement, comprising:

a platen housing;

a sub-structure integrally mounted on the platen housing; and a vacuum mounting arrangement configured to removably mount a fixed abrasive layer to the sub-structure, wherein the vacuum mounting arrangement includes suction holes at a top surface of the sub-structure vacuum connections through the sub-structure configured to connect the suction holes to a vacuum source, wherein the sub-structure includes a bottom cushion layer and an upper structural layer on the cushion layer.

2. The platen of claim 1, wherein the cushion layer comprises a low modulus pad and the structural layer comprises polycarbonate.

3. The platen of claim 1, further comprising a recess configured to house the sub-structure entirely within the recess.

4. The platen arrangement of claim 1, wherein the platen has an outer edge, and further comprising a seal on the outer edge on which outer edges of a fixed abrasive layer are removably mounted.

5. The platen arrangement of claim 1, wherein the platen has an outer edge, and further comprising an adhesive only on the outer edge on which outer edges of a fixed abrasive layer are removably mounted.

6. The platen arrangement of claim 1, wherein the sub-structure has a substantially planar upper surface that is co-planar with a top surface of the platen.

7. A platen for a fixed abrasive pad chemical-mechanical polishing/planarization arrangement, comprising:

a platen housing;

a sub-structure integrally mounted on the platen housing; and a vacuum mounting arrangement configured to removably mount a fixed abrasive layer to the sub-structure a cooling fluid arrangement in the platen that supplies cooling fluid to the sub-structure to cool the sub-structure.

8. A platen arrangement according to claim 7, wherein the vacuum mounting arrangement is coupled to a vacuum source and the cooling fluid arrangement in the platen is coupled to a cooling fluid source.

9. A platen arrangement according to claim 8, wherein thee sub-structure includes a bottom cushion layer and an upper structural layer on the cushion layer integrally mounted on the platen housing.

10. A platen arrangement according to claim 9, wherein the cooling fluid conduits are disposed adjacent the upper structural layer.

11. A chemical-mechanical polishing machine comprising:

a platen housing;

a sub-structure integral with the platen housing, said sub-structure comprising a bottom cushion layer and an upper structural layer on the cushion layer; and a mounting arrangement configured to removably mount a fixed abrasive layer to the upper structural layer of the sub-structure.

12. The machine of claim 11, further comprising a fixed abrasive pad removably mounted on the upper structural layer of the sub-structure.

13. The machine of claim 12, wherein the mounting arrangement comprises a vacuum mounting arrangement that includes suction holes at a top surface of the upper structural layer of the sub-structure, vacuum conduits through the sub-structure, and a source of vacuum coupled to the vacuum conduits.

14. The machine of claim 13, further comprising a cooling fluid arrangement in the platen including cooling fluid conduits that supplies cooling fluid from a cooling fluid source to the sub-structure to cool the sub-structure and the top polishing layer.

15. The machine of claim 14, wherein the cooling fluid conduits are disposed adjacent the upper structural layer.

16. The machine of claim 11, wherein the cushion layer comprises a low modulus material and the structural layer comprises polycarbonate.

17. The machine of claim 14, wherein the vacuum mounting arrangement is coupled to a vacuum source and the cooling fluid arrangement is coupled to a cooling fluid source.

18. A method of mounting a fixed abrasive layer to a platen arrangement, comprising the steps of:

providing a platen with an integral sub-structure comprising a bottom cushion layer and an upper structural layer on the cushion layer; and removably mounting a fixed abrasive layer on the sub-structure by vacuum mounting the fixed abrasive layer t o the sub-structure.

19. The method of claim 18, wherein the steps of removably mounting includes providing a seal on an outer edge of the platen with an outer edge of a fixed abrasive layer being mounted on the seal.

20. The method of claim 19, wherein the steps of removably mounting includes providing an adhesive on an outer edge of the platen with an outer edge of a fixed abrasive layer being mounted on the adhesive.

* * * * *